United States Patent [19]

Singh

[11] Patent Number: 4,484,590

[45] Date of Patent: Nov. 27, 1984

[54] PIPE WITH TOBACCO STORAGE

[76] Inventor: Prithvi P. Singh, 6101 Sheridan East Unit 22D, Chicago, Ill. 60660

[21] Appl. No.: 344,836

[22] Filed: Feb. 1, 1982

[51] Int. Cl.[3] ..... A24F 1/26

[52] U.S. Cl. ..... 131/180; 131/183

[58] Field of Search ..... 131/180, 181, 182, 183

[56] References Cited

U.S. PATENT DOCUMENTS 1,011,747 12/1911 Clark ..... 131/180
1,053,039 2/1913 Karnes ..... 131/180
4,216,786 8/1980 Wright ..... 131/180
4,294,267 10/1981 Glymph ..... 131/180
4,328,795 5/1982 Cabaniss ..... 131/180

*Primary Examiner*—V. Millin
*Attorney, Agent, or Firm*—John J. Simkanich

[57] ABSTRACT

A pipe for smoking tobacco with a separate storage compartment for additional tobacco, this compartment being formed as an integral portion of the pipe structure, and a tobacco burning bowl which is selectively positionable between a first smoking position and second tobacco loading position.

12 Claims, 9 Drawing Figures

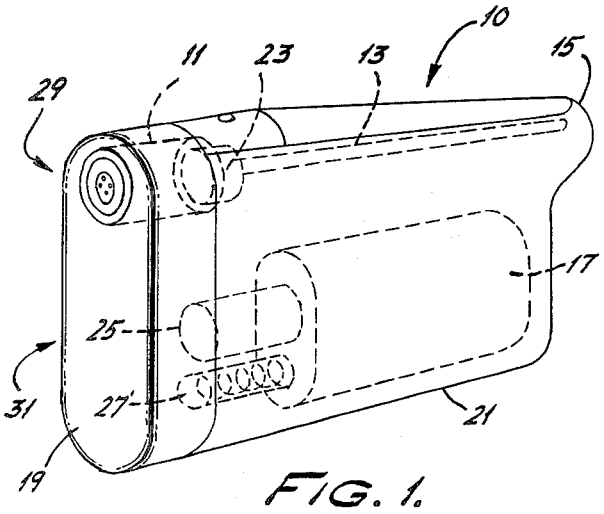
FIG. 1.
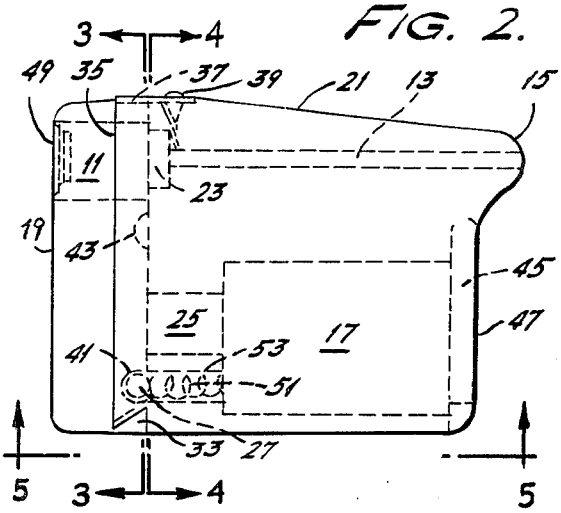
FIG. 2.
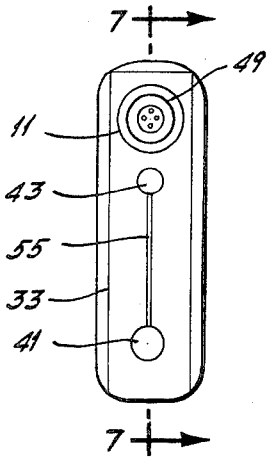
FIG. 3.
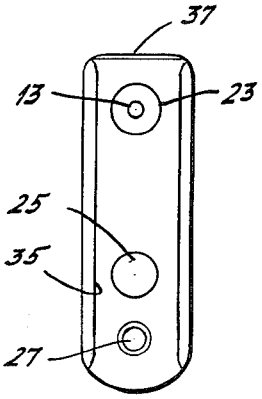
FIG. 4.
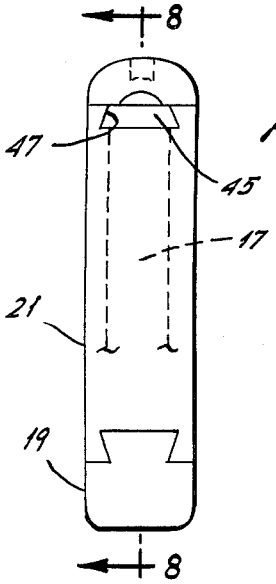
FIG. 5.
FIG. 6.
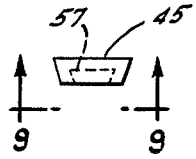
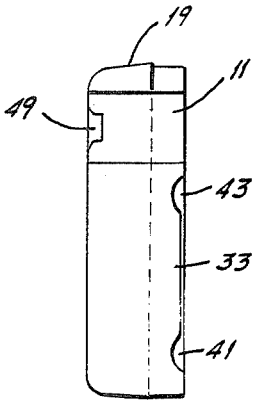
FIG. 7.
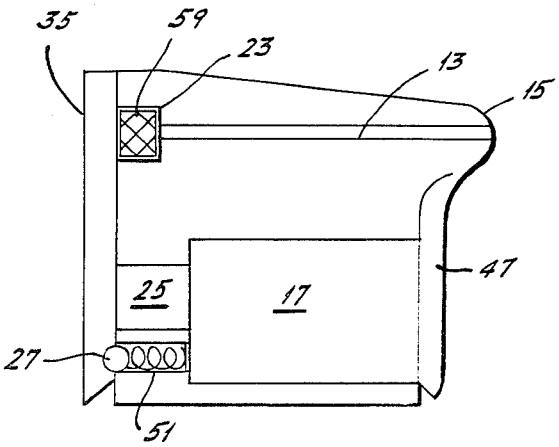
FIG. 8.
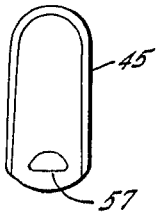
FIG. 9.

PIPE WITH TOBACCO STORAGE

BACKGROUND OF THE INVENTION

Tobacco pipes in the past have taken a traditional configuration usually limited to a tobacco burning bowl, a stem or smoke draw passageway connected to the bowl, usually at the bottom, and a mouthpiece at the end of the stem. The precise construction of the pipe has taken many variations depending principally upon the artistic inclinations of the maker. Traditionally the tobacco burning bowl has been constructed as a curved, circular bowl shape with an open top which may or may not be covered with a screen or cap. These screens or caps are removable or pivot open to permit loading of the bowl or cleaning of the bowl. As such the removable ones can come off accidentally and the pivotable ones can open accidentially either when the pipe is laid down or in the pocket of the smoker. In either instance tobacco can spill out of the bowl.

The stem or draw passageway is connected to the bowl at the bottom thereof so that the smoker draws the burning tobacco smoke down through the tobacco located in the bowl from the open top to the bottom connection with the stem. Traditional stems have either been straight or slightly curved connecting the bottom of the bowl to the mouthpiece.

Pipe bowls hold a limited supply of tobacco. A smoker will load an amount of tobacco desired. When this tobacco has been fully smoked a new or fresh load of tobacco is loaded into the bowl for a new smoke.

Most pipe smokers must therefore carry a supply of tobacco with them when engaging in pipe smoking. This additional pipe tobacco is either carried in its commercial package or storage tin or in a tobacco container or pouch specifically acquired to carry such additional amounts of fresh tobacco. This additional tobacco storage structure takes up a certain volume of space or "room". Often a pipe smoker will take his pipe but forget his tobacco tin or tobacco pouch.

With the continuing development of woodworking skills, more intricate and artistic configurations for pipes are being developed. While synthetic materials may sometimes be available, natural wood still remains the most desirable material from which to build a tobacco pipe. What is desirable is a tobacco pipe having in combination a tobacco storage compartment and a structure for automatically loading such additional tobacco from this storage compartment into the smoking bowl, cap over the bowl to prevent spillage of tobacco and an interlocking structure which will permit disassembly of the pipe for accessing the bowl for cleaning or filling only upon positive act of the smoker.

An object of this invention is to provide a combination tobacco smoking pipe and storage compartment.

A second object of this invention is to provide such a pipe with a smoking bowl selectively positionable between a first smoking position and a second tobacco loading position.

A third object of this invention is to provide such a pipe where the bowl is slidable between such first and second positions.

Another object of this invention is to provide such a pipe with an indicator structure which automatically marks the first and second position.

An additional object of this invention is to provide such a pipe with a permanent bowl cap which will prohibit tobacco from spilling out of the bowl while allowing air to be drawn into the bowl for smoking.

An additional object of this invention is to provide the storage completely separate and deseparate from the smoking bowl when it is in the first or smoking position.

A further object of this invention is to provide such a pipe with interlocking structure which inhibits disassembly and access to the bowl except by positive act of the smoker.

An even further object of this invention is to provide such a pipe with a rounded configuration readily adaptable to a comfortable position in the smoker's hand and with a generally narrow profile which easily fits into the smoker's pocket.

SUMMARY OF THE INVENTION

The objects of this invention are realized in a pipe for smoking tobacco having in combination as part thereof a tobacco bowl, a stem or smoke draw passageway, a mouthpiece, a storage compartment for additional tobacco, a tobacco filler leading from the storage compartment and a filter compartment between the smoking bowl and the stem.

This combination structure is configured as a single unit having two members which may be selectively moved in relation to one another and which have a generally narrow profile for ease of carrying in a purse or pocket and a rounded configuration which is comfortably craddled in the smoker's palm.

A body member contains a filter compartment for holding a smoke filter and which is connected to a smoke drawing passageway or stem. Positioned adjacent to the smoke drawing passageway and within body member is a tobacco storage compartment with an access cover at one end and a filler hole or discharge opening at the other end.

A slide member operates in conjunction with and relative to the body member and contains a tobacco burning bowl which is selectively movable between a first position in alignment with the filter and filter compartment, exclusively, and a second position in alignment with the storage compartment discharge opening, exclusively. Position indicating means provide interlocking structure which marks the operation of the slide member in conjunction with the body member as to the first or smoking position and the second or filling position.

A permanent cap is positioned over the bowl. The position indicating interlocking structure permits selective separation of the slide member from the body member for accessing the bowl for cleaning.

DESCRIPTION OF THE DRAWINGS

The features, operation and various advantages of the invention will be readily determined from a reading of the following detailed description in conjunction with the accompanying drawings in which like numerals refer to like elements and in which:

FIG. 1 shows a perspective view of the combination pipe invention.

FIG. 2 is a side view of the assembled pipe showing its internal structure.

FIG. 3 is a view of the mating face of the slide member taken as shown in FIG. 2.

FIG. 4 is a view of the mating face of the body member taken as shown in FIG. 2.

FIG. 5 shows a bottom view of the pipe from the storage compartment end.

FIG. 6 shows an end view of the slide cover to the storage compartment.

FIG. 7 is a cross sectional view of the slide member along a longitudinal plane through the slide member.

FIG. 8 is a cross sectional view of the body member through a longitudinal plane taken as shown in FIG. 5.

FIG. 9 is a top view of the slide cover to the storage compartment.

DETAILED DESCRIPTION OF THE INVENTION

A narrow profile combination pipe structure 10, FIG. 1, contains a tobacco burning bowl 11 connected to a stem or smoke drawing passageway 13 leading to a mouthpiece 15, in combination with a separate storage compartment 17 for holding additional unused tobacco.

The tobacco burning bowl 11 is contained in a slide member 19, slideable in combined operation and relative to a body member 21. These members 19, 21 having mating faces in contact with one another. This body member 21 contains the smoke drawing passageway 13 as well as providing the mouthpiece structure 15.

A filter compartment 23 is situated at the end of the smoke drawing passageway 13 immediately adjacent to the tobacco burning bowl 11. Positioned at one end of the tobacco storage compartment 17 is a discharge or filler opening being the filler hole 25 for new tobacco to be loaded into the bowl 11. A spring biased ball latch 27 is located adjacent the filler hole 25 to operate on the slide member 19 and define a first and second positions 29, 31, respectively, for the operation of the bowl 11 in the smoking mode and in the filling mode, respectively.

The slide member 19, FIG. 2, has an essentially elongate shape with rounded edges and rounded corners on the outside walls as well as a male dovetail mortise 33 which mates with a mating female mortise 35 on the body member 21. These mortises 33, 35 are interlocked by virtue of their dovetail structure and allow the slide member 19 to slide in fixed juxtaposed position with respect to the body member 21 in a plane perpendicular to the longitudinal axis of the filter compartment 23 and filler hole 25, from the top of the body member 21 to the bottom. The smoke drawing passageway 13 is located to the top of the body member 21 while in the storage compartment 17 is situated at the bottom. A rectangular metal stop plate 37 is held to the top of the body member 21 by a screw 39 or other securing means. This stop plate 37 limits the movement of the slide member 19 at the top of the body member 21 when the slide member 19 is in the "track" defined by the mating dovetail mortises 33, 35 and it brings the slide and body members 19, 21 outer surfaces into alignment with one another when the slide member 19 abuts the stop plate 37.

With the slide 19 abutting the metal stop plate 37, the bowl 11 opening is aligned with the filter compartment 23 and consequently the smoke drawing passageway or stem 13 so that the pipe 10 can be operated in the smoking mode.

The face formed by the male dovetail mortise 33 of slide member 19 forms the mating face of the slide member and contains a first and second semicircular detent holes 41, 43, respectively. The first detent hole 41 engages the ball latch 27 when the bowl 11 is in the first position 29, while the second detent hole 43 engages the ball latch 27 when the bowl 11 is in the second position 31. The operation of the detent holes 41, 43 and the ball latch 27 provide an interlocking structure for maintaining the slide member 19 selectively in the first or second positions 29, 31.

Filler hole 25 directly accesses and connects the storage compartment 17 with the bowl 11 when the bowl 11 is in the second position 31. The opposite end of the storage compartment 17 from the filler hole 25 is covered by a sliding cover 45 which operates in a dovetail slot 47 in the body member 21 adjacent to the mouthpiece 15.

A round, dish shaped screen or cap 49 is fitted into the outer surface of the slide member 19 to cover that open side of the bowl 11. The openings in the screen or cap 49 are large enough to permit an adequate flow of air for smoking the tobacco held in the bowl 11 while small enough to contain the pieces of tobacco held in the bowl 11.

A spring 51 biases the ball latch 27 in an outward position for mating one of the detent holes 41, 43. This spring 51 is held within a cylinder 53 and is strong enough to provide an interlocking "hold" in a selected position but can be overcome to allow travel between positions or disassembly of the pipe 10.

While the pipe 10 and its various elements may be made from any of a number of suitable materials, certain materials are more desirable because they have been traditionally used in pipe making and are aesthetically pleasing to the purchaser or because they are quite suitable for the intricate shaping or forming operations needed to make those various elements. The slide member 19 and body member 21 can be made from any number of various woods such as teak, walnut, ash, redwood or other type. These two members 19, 21 are made with smooth surfaces and rounded corners with a narrow profile to provide a pipe 10 with a profile which will easily fit in a user's pocket or purse and be comfortably craddled in the palm of the hand.

The bowl 11 and first and second detent holes 41, 43 can be drilled or otherwise machined or formed in a solid piece of wood forming the slide member 19. Likewise, with the body member 21, the stem or smoke drawing passageway 13, filter compartment 23, storage compartment 17 and filler hole 25 can be formed by drilling or machining these cavities in a solid block of wood from which the body member 21 is made. A cavity can likewise be made in the body member to receive and hold the cylinder 53 which retains the spring 51 and ball latch 27 in position.

While the bowl, filter compartment 23, filler hole 25 and smoke drawing passageway 13 can be made in any of many different shapes, they are most easily and conveniently created by drilling circular cavities. Likewise, the cavity for holding the detent ball 27 cylinder 53 can be a cylindrical cavity. The storage compartment 17 is easily made elongate or oval by joining a pair of spaced apart cylindrical bores by removing the material between them to form the elongate or oval cavity.

A small tip extends outwardly on the body member 21 near the storage compartment 17 cover 45 to form a smooth and rounded protruding mouthpiece 15. The lower surface of this mouthpiece 15 is curved to comfortably receive the lower lip of a smoker.

The screen or cap 49 is made out of the circular stamping of brass or other soft metal in a dish shaped circular pattern with a plurality of holes or other openings, FIG. 3. The ball latch 27 is a steel ball bearing biased to an initial position by a steel spring 51 and held within a brass cylinder 53. The cylinder 53 is inserted through the mating face of body 21.

The mating face of the slide member 19 forms a flat plane which contains the first and second detent holes 41, 43, FIG. 3, having a small shallow groove 55 (this groove 55 being optional), to join the first and second detent holes 41, 43 and run along the mating face of the slide member 19. The detent holes 41, 43 are positioned to extend directly, in a perpendicular manner, into the slide member 19 from the mating face thereof. The bowl 11, likewise extends perpendicularly into the slide member 19 from its mating face. The male dovetail mortise 33 can extend at an angle of from 15 to 25 degrees. It has a straight end to abut against the underside of the metal stop plate 37. Its opposite end tapers into the outer surface of the slide member 19.

The filler hole 25, FIG. 4, is positioned a distance from the ball latch 27 so that when the ball latch 27 engages the second detent hole 43 the filler hole 25 is centered over having its axis concentric with the axis of bowl 11 and opens directly thereinto.

The filter compartment 23 extends perpendicularly into the body member 21 from the slide member mating face. The smoke drawing passageway 13 extends from the filter compartment 23 and is concentric with its longitudinal axis.

Both the filler hole 25 and the ball latch cylinder 53 extend perpendicularly into the body member 21 from the slide member mating face.

Storage compartment cover 45 is dovetailed at the same 15 to 25 degree angle as the dovetail mortises 33, 35 of the slide and body members 19, 21. This cover 45, FIGS. 6 and 9, contains a fingernail grip 57 in the outer surface for sliding the cover away from the mouthpiece 15 in order the access the storage compartment 17.

The bowl 11, FIGS. 7 and 8, is formed by a circular cavity drilled completely through the slide member 19. The first and second detent holes 41, 43 extend partially into the male dovetail mortise 33 to a depth not greater than one half the height of this mortise 33. While the various elements can be of any of various sizes, the size of the pipe 10 along with its various elements is substantially tied into the size of the smoking bowl 11.

A commercially available filter 59 is positionable in the filter compartment 23. This filter 59 is of the fiber brass screen or charcoal type, similar to those available on the ends of filter cigarettes or those available in tobacco accessory shops. Typically, this filter can be sized of the same diameter as found on many of the most popular filter cigarettes. The diameter of the filter compartment can be approximately thirty to sixty percent smaller than the diameter of the bowl 11. The diameter of the smoke drawing passageway 13, which can be a straight bore leading from the filter compartment to the mouthpiece 15, can be from ten to thirty percent of the diameter of the bowl 11.

Typically, the storage compartment capacity is equivalent to three to seven fillings of the bowl 11. The filler hole 25 need only be of a size which will easily pass the tobacco cuttings from the storage compartment 17 to the bowl 11. Typically, the diameter of this filler hole 25 is approximately fifty to seventy-five percent of the diameter of the bowl 11.

When using the pipe, the cover 57 is pulled out of the slots 47 to access the storage compartment 17 and to fill this compartment 17 with tobacco. The cover 45 is then replaced. To load the bowl 11 the slide member 19 is moved to the second position 31 with the bowl 11 adjacent the filler hole 25. The pipe is inverted so that tobacco is free to fall automatically out of the storage compartment 17 through the filler hole 25 into the bowl 11. Tapping the pipe can cause the tobacco cuttings to shift about slightly and aid this filling operation. The bowl 11 and slide member 19 are then moved back to the first position 29.

With the pipe 10 held in the horizontal position so that the bowl 11 filter compartment 23 and stem or smoke drawing passageway 13 each extend horizontally, the tobacco held in the bowl 11 can be lit by drawing a flame through the openings in the cap 49. Any ash passing out of the bowl 11 by the drawing of the smoke into the passageway 13 would be trapped in the filter 59. The pipe can be disassembled for cleaning by sliding the slide member 19 completely out of and away from the body member 21. The spring force of the spring 51 operating on the ball latch 27 is not of a sufficient pressure to inhibit the complete separation of the slide member 19 from the body member 21.

The shape of the pipe and its various elements described herein can be varied without departing from the intent and scope of the invention. Likewise, the arrangement of the elements and the relative position and sizes as well as the shapes of these elements may likewise be varied without departing from the intent and scope of the invention. It is intended, therefore, that the description above be interpreted as being illustrative and not be taken in the limiting sense.

What is claimed is:

1. A pipe comprising:

body member means including a smoke drawing passageway; a mouthpiece connected to said smoke drawing passageway; a storage compartment adjacent said smoke drawing passageway; and a filler opening leading from said storage compartment; and tobacco burning means including a slide member having means for sliding exclusively in a rectalinear fashion, said tobacco burning means having a bowl in slidable engagement with said body member means; and a plurality of position indicators on said slide member; wherein said bowl is slidably positionable to access said smoke drawing passageway and said filler opening from said storage compartment on an exclusive basis.

2. The pipe of claim 1 also including a filter compartment connected to said smoke drawing passageway, said filter compartment accessing said bowl when said bowl is in said first smoking position.

3. The pipe of claim 2 wherein said slide member rectalinear slide means includes dove tail mortise, said body member slidably engaged with said slide member by a mating interlocking dove-tail mortise, said slide member and said body member having juxtaposed mating faces in contact with one another.

4. The pipe of claim 3 wherein said plurality of position indicators includes a ball latch extending outwardly on said body member mating face, and a pair of spaced apart detent holes on said slide member mating face.

5. The pipe of claim 4 wherein said ball latch is spring biased to resiliently engage either of said pair of detent holes, and said pair of detent holes and ball latch are positioned on their respective mating faces to resiliently lock said slide member on said body member with said bowl selectively in said first smoking position and said second tobacco filling position.

6. The pipe of claim 5 also including a perforated cap over said bowl, a filter positioned in said filter compartment, and a fill opening to said storage compartment, said fill opening being selectively closed by a sliding cover.

7. The pipe of claim 6 also including a stop plate mounted on said body member at one end of said body member dovetail mortise.

8. The pipe of claim 7 wherein said slide member and said body member are made of wood, having smooth faces and rounded surfaces, said pipe providing a generally narrow profile.

9. The pipe of claim 8 wherein said bowl is formed by a cylindrical bore in said slide member, wherein said filter compartment and said smoke drawing passageway in said body member are each cylindrical bores in concentric alignment with one another, and wherein said bowl cap is of cylindrical dish shape of metallic material including air openings therethrough.

10. The pipe of claim 9 wherein said storage compartment is an oval shaped cavity and wherein said filler opening includes a cylindrical bore leading from said oval shaped cavity to said body member mating face.

11. A pipe with tobacco storage comprising:

a body member having a storage compartment and a smoke drawing passageway separate from one another; and a slide member containing a burning compartment and slidably mounted onto said body member along a longitudinal path to bring said burning compartment into contact with said storage compartment in a first slide position and said burning compartment into contact with said smoke drawing passageway in a second slide position.

12. The pipe of claim 11 wherein said body member includes a track upon which said slide member slides, said track keeping said body member and said slide member in alignment.

* * * * *